US010000329B2

(12) United States Patent
Knight et al.

(10) Patent No.: US 10,000,329 B2
(45) Date of Patent: Jun. 19, 2018

(54) THERMALLY INSULATED SHIPPING CONTAINER

(71) Applicant: LAMINAR MEDICA LIMITED, Hertfordshire (GB)

(72) Inventors: Philip Knight, Hertfordshire (GB); Michael Houlding, Hertfordshire (GB)

(73) Assignee: Laminar Medica Limited, Hertfordshire (GB)

( * ) Notice: Subject to any disclaimer, the term of this patent is extended or adjusted under 35 U.S.C. 154(b) by 339 days.

(21) Appl. No.: 14/648,421

(22) PCT Filed: Nov. 25, 2013

(86) PCT No.: PCT/GB2013/053097
§ 371 (c)(1),
(2) Date: May 29, 2015

(87) PCT Pub. No.: WO2014/083320
PCT Pub. Date: Jun. 5, 2014

(65) Prior Publication Data

US 2015/0298886 A1 Oct. 22, 2015

(30) Foreign Application Priority Data

Nov. 30, 2012 (GB) ..... 1221629.7

(51) Int. Cl.
*B65D 81/38* (2006.01)
*B65D 81/18* (2006.01)
(Continued)

(52) U.S. Cl.
CPC ..... *B65D 81/18* (2013.01); *B65D 19/06* (2013.01); *B65D 81/3823* (2013.01); *F25D 3/06* (2013.01);
(Continued)

(58) Field of Classification Search
CPC ..... B65D 81/18; B65D 19/06; B65D 2519/00875; F25D 3/06; F25D 3/08;
(Continued)

(56) References Cited

U.S. PATENT DOCUMENTS 649,222 A 5/1900 Smith
3,765,556 A 10/1973 Baer
(Continued)

FOREIGN PATENT DOCUMENTS

DE 102005013263 A1 9/2006
EP 2053325 A1 4/2009
(Continued)

OTHER PUBLICATIONS

International Search Report for PCT/GB20131053097 dated Apr. 3, 2014, 4 pages.
(Continued)

*Primary Examiner* — Luan K Bui
(74) *Attorney, Agent, or Firm* — Withrow & Terranova, PLLC

(57) ABSTRACT

A thermally insulated shipping container comprises an inner structure including an inner base, a front inner wall, a rear inner wall opposed to the front inner wall, a pair of opposed side inner walls each extending between the front and rear inner walls and an inner lid; an outer structure including an outer base, a front outer wall, a rear outer wall opposed to the front inner wall, two side outer walls each extending between the front and rear outer walls and an outer lid; and a cavity extending at least between the inner and outer walls, the cavity being arranged to receive a plurality of cool packs; wherein the container, when empty, is arranged to be transported disassembled in a flat packed state prior to being assembled for use.

20 Claims, 7 Drawing Sheets

(51) Int. Cl.
*F25D 3/06* (2006.01)
*B65D 19/06* (2006.01)

(52) U.S. Cl.
CPC ..... *B65D 2519/00875* (2013.01); *F25D 2303/0832* (2013.01); *F25D 2303/0843* (2013.01); *F25D 2303/0844* (2013.01); *F25D 2323/061* (2013.01)

(58) Field of Classification Search
CPC ..... F25D 2303/0843; F25D 2303/0844; F25D 2323/061
USPC ..... 206/386, 600; 62/371, 457.1, 457.2; 220/4.28, 4.29, 592.2, 592.24
See application file for complete search history.

(56) References Cited

U.S. PATENT DOCUMENTS

| | | | | |
|---|---|---|---|---|
| 3,784,043 | A | 1/1974 | Presnick | |
| 4,606,461 | A * | 8/1986 | Bolton, Sr. | B65D 19/20 206/600 |
| 5,076,457 | A | 12/1991 | Marovskis | |
| 5,199,589 | A | 4/1993 | Noble | |
| 5,215,248 | A * | 6/1993 | Moser | B65D 5/326 206/600 |
| 5,601,202 | A | 2/1997 | Meacham et al. | |
| 5,669,233 | A * | 9/1997 | Cook | B65D 19/06 62/371 |
| 5,829,595 | A * | 11/1998 | Brown | B65D 19/0018 206/386 |
| 5,979,693 | A * | 11/1999 | Bane, III | B65D 81/3825 220/4.28 |
| 6,325,281 | B1 * | 12/2001 | Grogan | B65D 81/3862 220/592.25 |
| 6,752,285 | B1 | 6/2004 | Scalf | |
| 8,074,465 | B2 * | 12/2011 | Heroux | A01N 1/02 62/371 |
| 8,919,082 | B1 * | 12/2014 | Cataldo | B65D 81/3816 220/4.29 |
| 2009/0039088 | A1 | 2/2009 | Williams et al. | |
| 2009/0078699 | A1 | 3/2009 | Mustafa et al. | |
| 2011/0049164 | A1 | 3/2011 | Banks et al. | |
| 2013/0228583 | A1 * | 9/2013 | Mayer | B65D 21/0223 220/4.29 |

FOREIGN PATENT DOCUMENTS

| | | | |
|---|---|---|---|
| GB | 2293160 | A | 3/1996 |
| GB | 2508415 | A | 6/2014 |
| WO | 2008122074 | | 10/2008 |
| WO | 2009035661 | A1 | 3/2009 |
| WO | 2011075198 | A1 | 6/2011 |
| WO | 2014083320 | A1 | 6/2014 |

OTHER PUBLICATIONS

Search Report for British Patent Application No. GB1221629.7 dated Mar. 28, 2013, 4 pages.
Search Report for British Patent Application No. GB1221629.7 dated Jun. 14, 2013, 3 pages.
Examination Report for European Patent Application No. 13799632.8, dated Apr. 12, 2018, 6 pages.

* cited by examiner

Figure 1
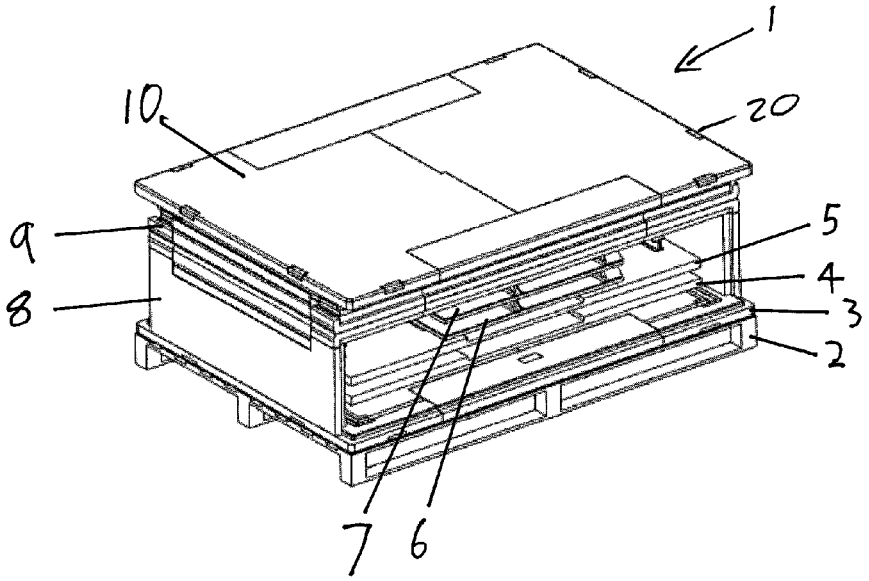
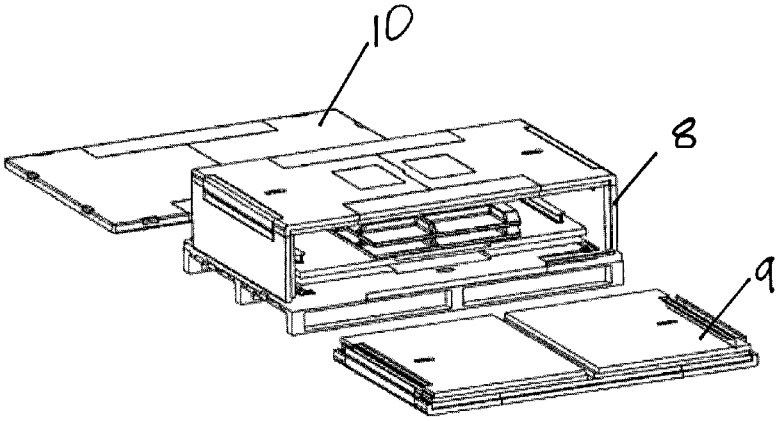
Figure 2

Figure 3
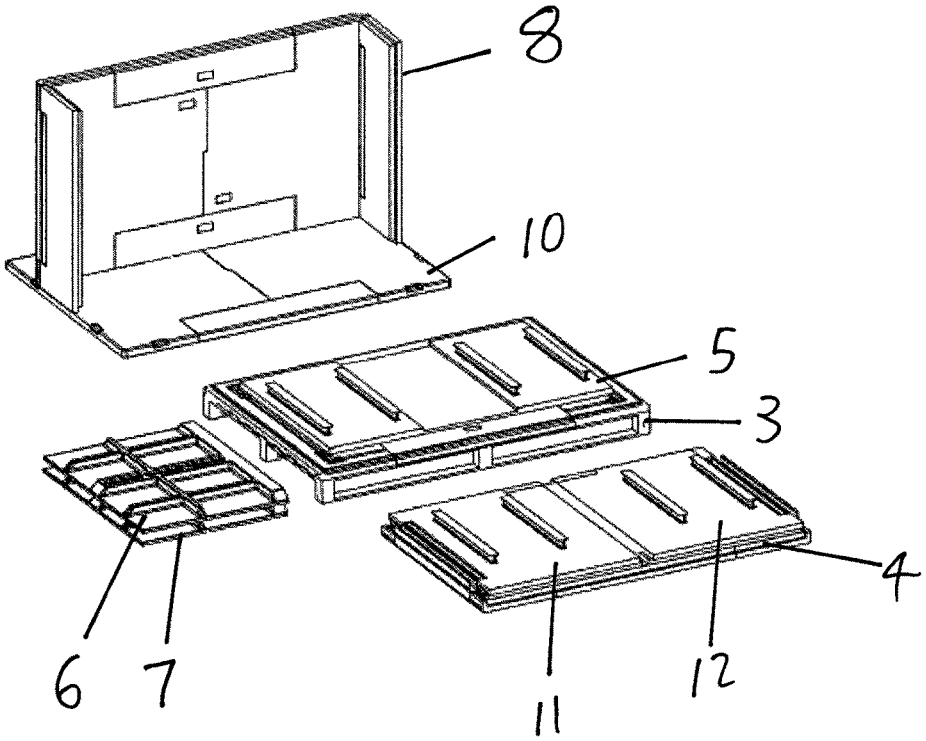
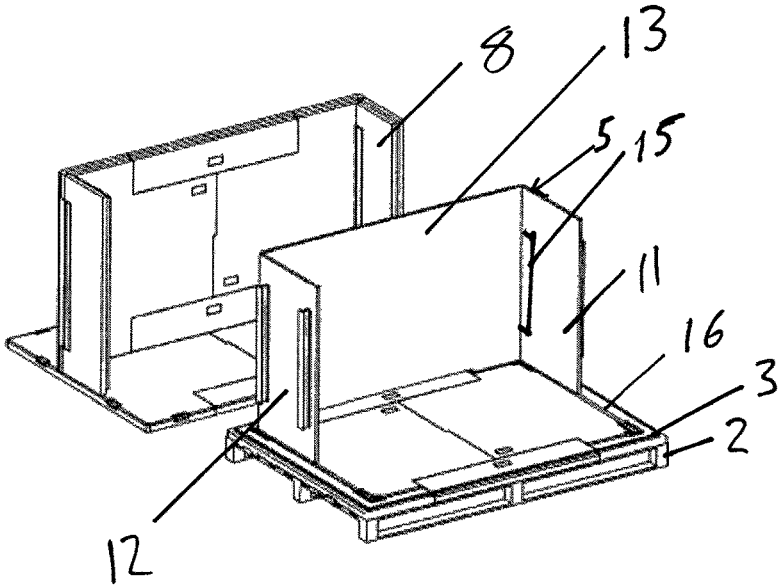
Figure 4

Figure 5
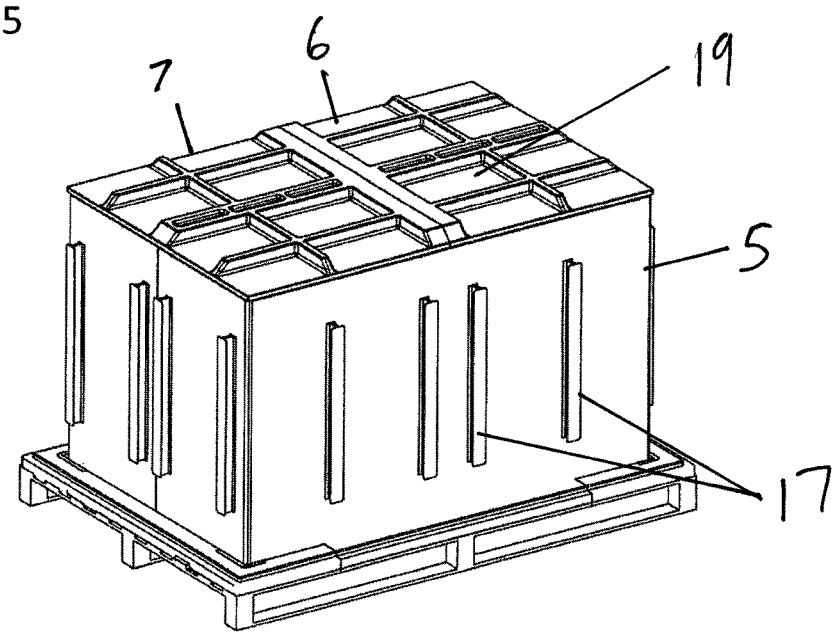
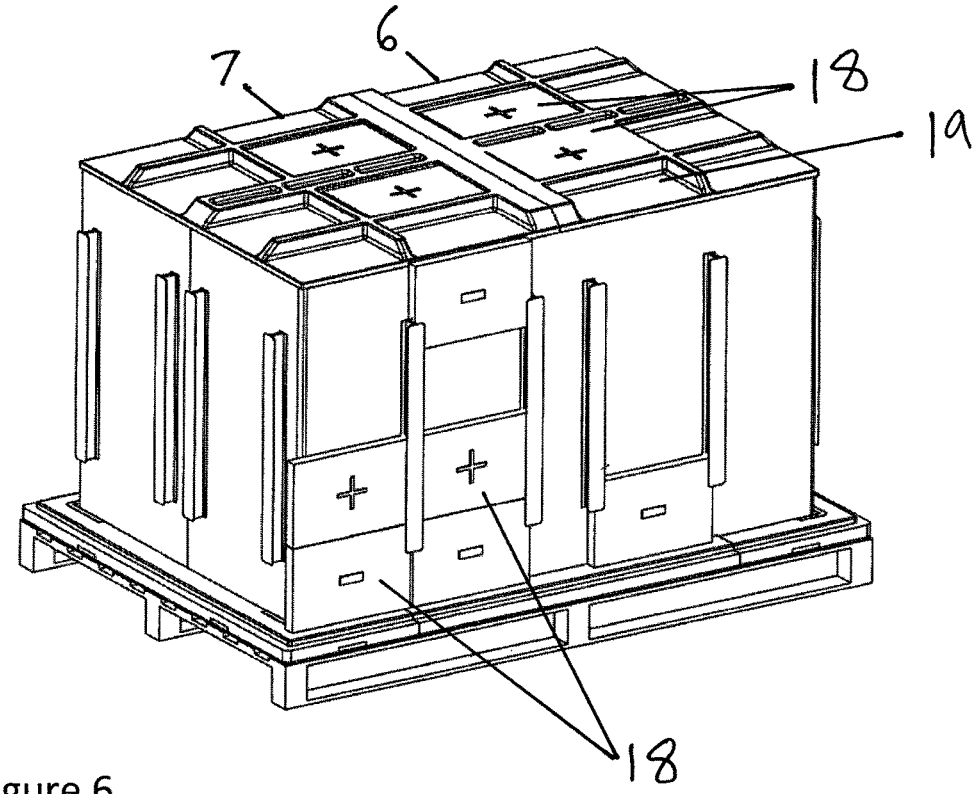
Figure 6

Figure 7
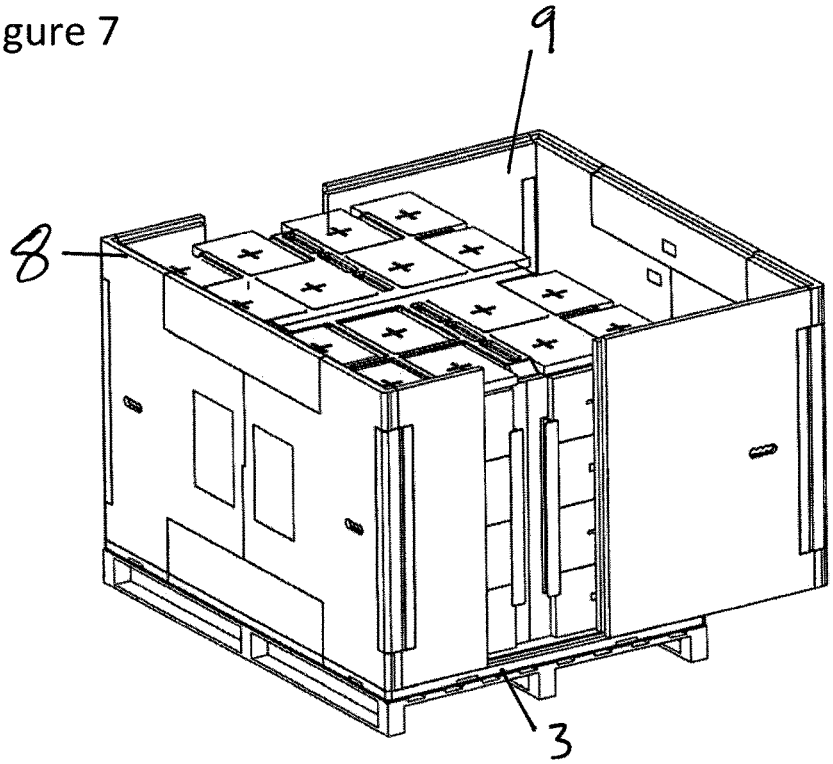
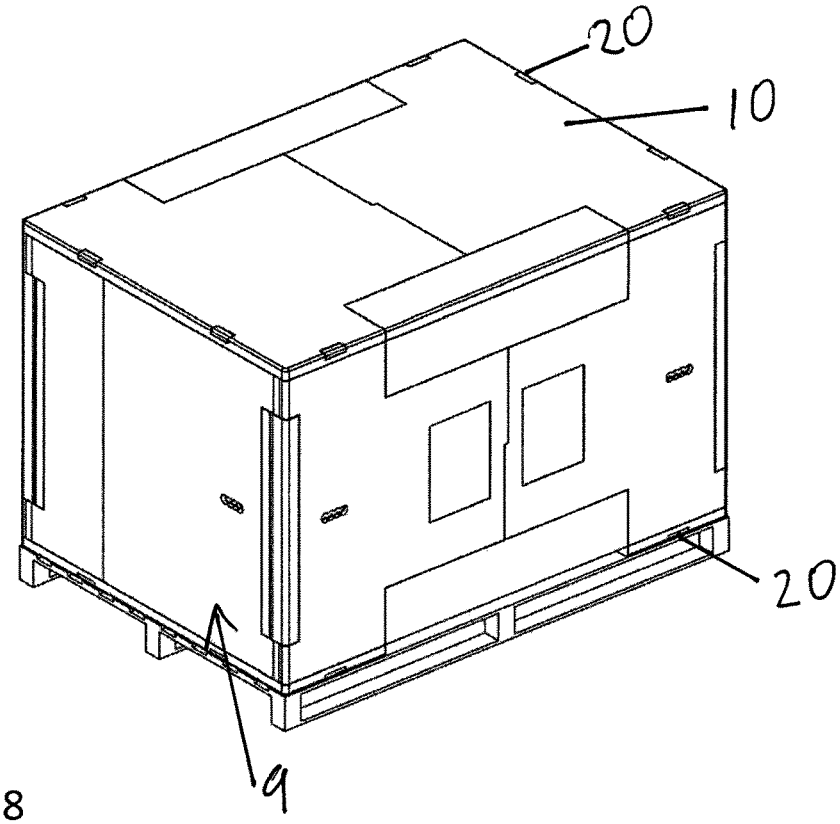
Figure 8

Figure 9
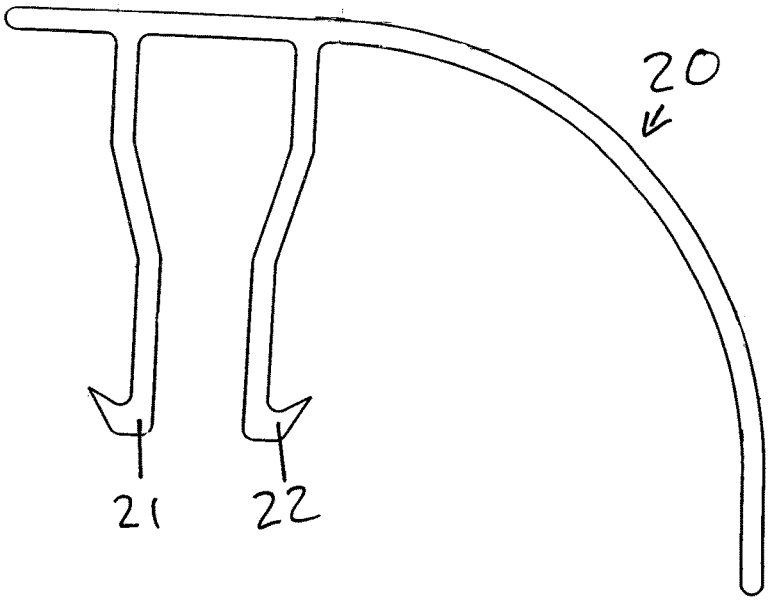
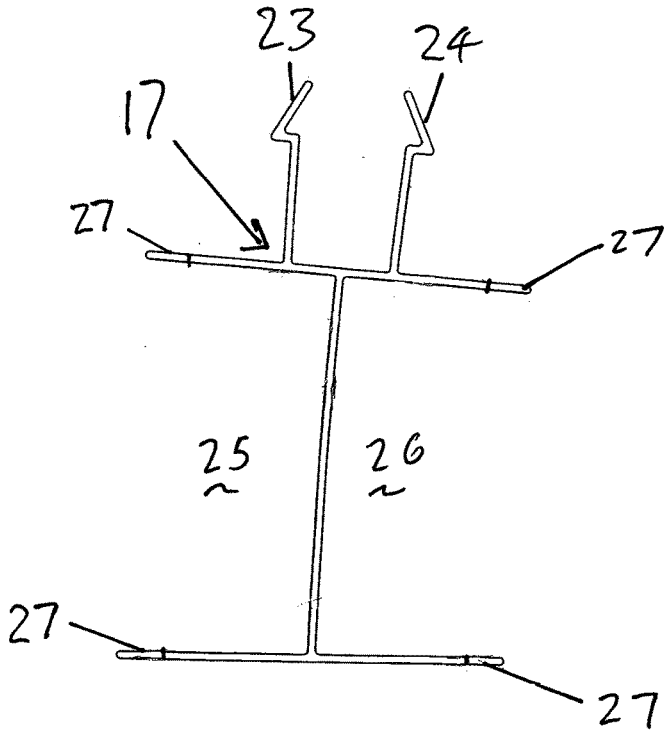
Figure 10

Figure 11
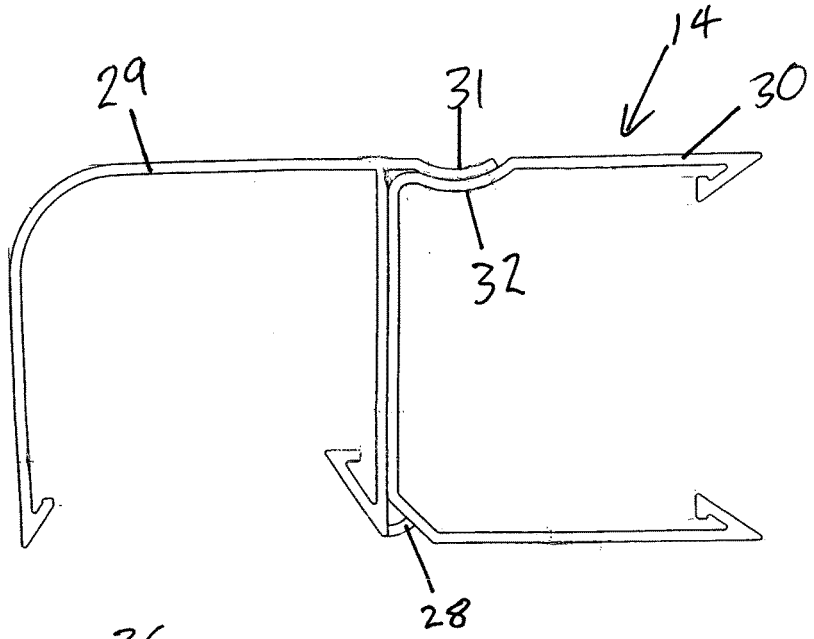
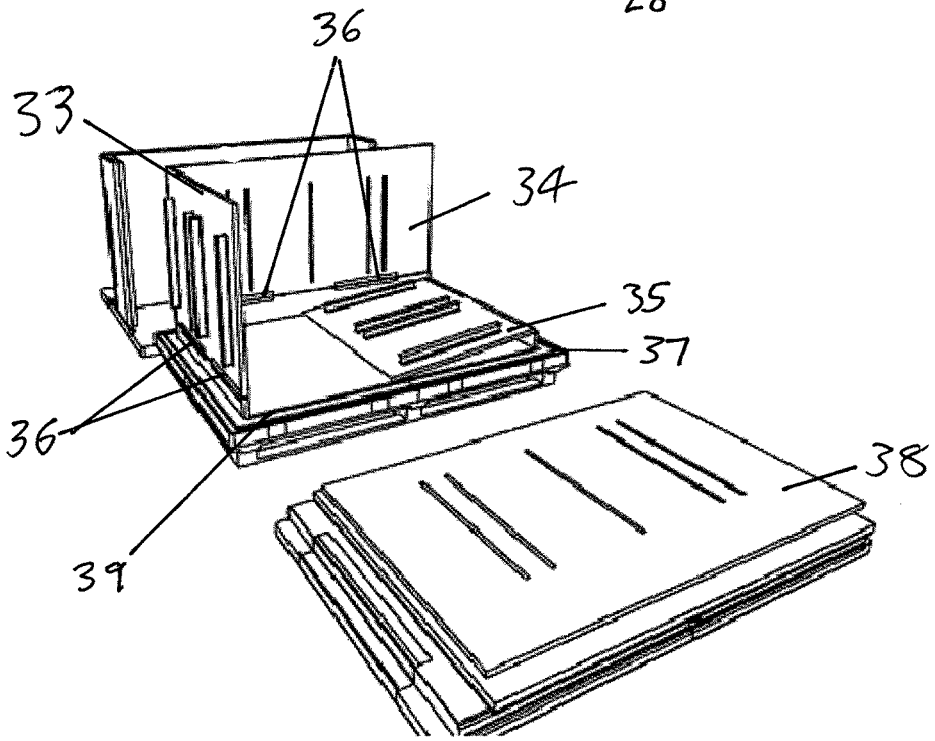
Figure 12

Figure 13
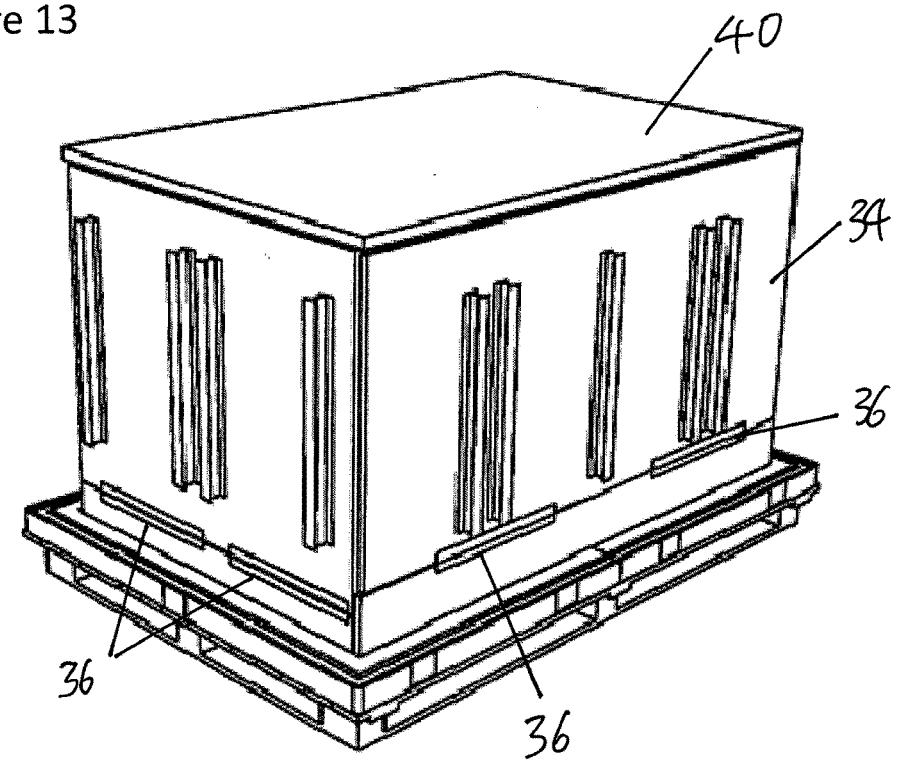
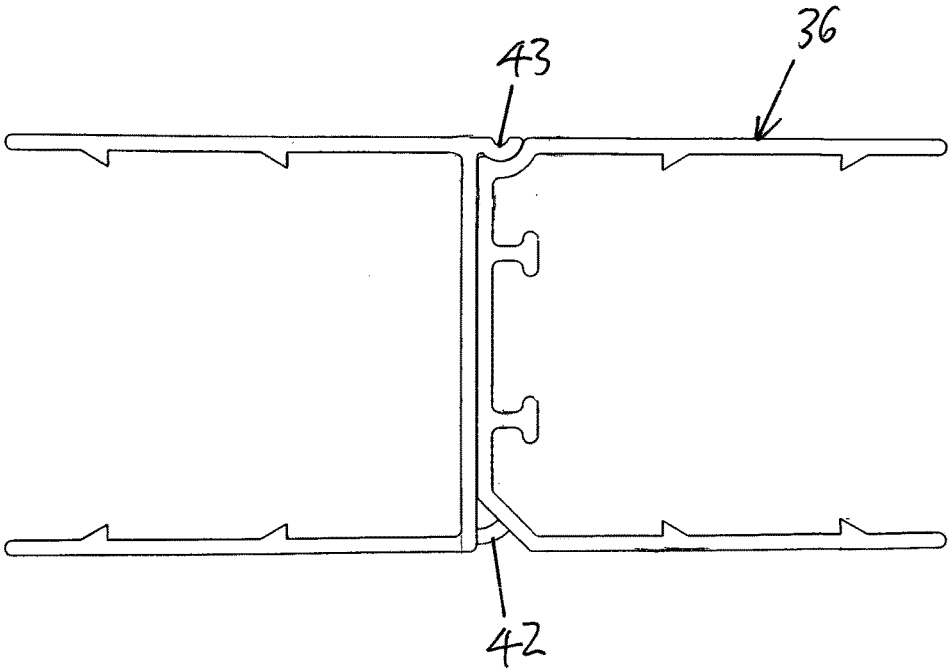
Figure 14

THERMALLY INSULATED SHIPPING CONTAINER

PRIORITY APPLICATIONS

The present application is a U.S. National Stage application under 35 U.S.C. § 371 of and claims priority to International Application No. PCT/GB2013/053097 filed on Nov. 25, 2013 entitled "A THERMALLY INSULATED SHIPPING CONTAINER," now International Publication No. WO 2014/083320 A1, which claims priority to GB Patent Application No. 1221629.7 filed on Nov. 30, 2012 entitled "A THERMALLY INSULATED SHIPPING CONTAINER," now GB Patent Application Publication No. GB 2508415 A, all of which are incorporated herein by reference in their entireties.

FIELD OF DISCLOSURE

The present disclosure relates to a thermally insulated container and particularly to what is generally termed a pallet shipper, where the footprint of the container has the same dimensions as one of a number of standard pallets, which may be of industry or international standard sizes. The embodiments disclosed herein may have particular application to an air cargo pallet shipper. Such pallet shippers may be arranged to be carried by a pallet, may be mounted to a pallet, or may have a pallet formed integrally therein.

BACKGROUND

It is important that some products, for example certain type of pharmaceuticals or biotech products, are maintained within a specified temperature range, typically 2° to 8° C., to prevent the product from being damaged, or its shelf-life being reduced relative to the shelf-life stated on the product. The product may be a very high value medicine or the like, which will be worthless if its temperature is not correctly controlled. This may be problematic during shipment, particularly if the product is being shipped by air.

In order to maintain the temperature of a product during shipment of a product, the product will often be shipped in an insulated container, known as an insulated shipper, which may or may not be a pallet shipper.

One type of shipper is the active shipper. This generally comprises a thermally insulated container having a cooling device and/or heating element for controlling the interior temperature of the shipper and thus the product. Energy is provided, often from an external electrical supply, or an internal battery.

An advantage of an active shipper is that, in the case where it is connected to an external power supply, the temperature may be maintained within a desired range for a relatively long, or indefinite, period of time. However, a disadvantage of active shippers is that they can be less reliable than passive shippers, for example they can be subject to mechanical breakdown and may be reliant on being correctly connected to a reliable external power supply.

A further disadvantage of active shippers is that they require inspection and maintenance to ensure they are correctly functioning and are relatively more expensive than the equivalent passive shipper. For this reason, they are often rented and thus availability may be a problem, where orders to transport a product may be received at short notice.

Renting active shippers in case they should be required is both expensive and space consuming.

An alternative type of shipper is the passive shipper. This relies on cool blocks (which may be frozen or chilled) being placed around the product to maintain the product within a desired temperature range. A disadvantage of the passive shipper, relative to the active shipper, is that product may only be maintained in the desired temperature range for a finite time, determined in part by the quantity and type of cool packs used. However, this is acceptable in many applications, where the shipment time is relatively short, for example if the product is to be shipped by air.

A major advantage of passive shippers is that, provided they are correctly packed and do not experience unforeseen extremes of temperature, the product should be safely maintained within a given temperature range for a specified period of time, without reliance on any external factors. Other advantages of passive shippers are that they require no maintenance and are inexpensive relative to equivalent active shippers. Passive shippers are commonly distributed flat packed, to reduce "in-bound" delivery costs, which makes it practical for them to be kept in stock, so they are readily available should they be required.

As stated above, delivering passive shippers flat packed does have advantages, however a disadvantage of passive shippers being delivered flat packed is that it significantly increases pack out times, compared to active shippers, which only have to be loaded with a product.

A passive shipper typically comprises a base on which a product is to be carried, at least four inner wall panels to surround the product, a number of uprights between the panels and a lid. A further set of uprights may be provided, to be secured around the inner wall for supporting a large number of cool packs. At least four outer wall sections are also provided which, when the cool packs have been put in place, are assembled around the cool packs and secured to the uprights. More cool packs are then placed on top of the inner lid prior to an outer lid being placed on the shipper ready for shipping.

Thus, ignoring the cool packs, a passive shipper may require twenty or more components to be assembled. This may not be too much of a problem in the case of a small shipper being assembled by an experienced assembler, but it can be problematic in the case of larger shippers, which may be several meters high, wide or deep, requiring two or more people to first unpack the components, which will normally have been delivered as a flat packed assembly on a base pallet. A significant amount of working space is thus required to arrange the components prior to the components then being correctly assembled to form the assembled shipper.

The incorrect laying out of the components as they are initially unpacked may hamper assembly, increasing the pack out time and costs. This may be particularly problematic if experienced staff are not available. It also increases the risk of errors in assembly, which may result in a failed shipment or temperature excursions outside of the predetermined range.

SUMMARY OF THE DETAILED DESCRIPTION

According to embodiments of the present disclosure, there is provided a thermally insulated shipping container comprising: an inner structure including an inner base, a front inner wall, a rear inner wall opposed to the front inner wall, a pair of opposed side inner walls each extending between the front and rear inner walls and an inner lid; an outer structure including an outer base, a front outer wall, a rear outer wall opposed to the front inner wall, two side outer walls each extending between the front and rear outer walls and an outer lid; and a cavity extending at least between the inner and outer walls arranged to receive a plurality of cool packs; wherein the container, when empty, is arranged to be transported disassembled in a flat packed state prior to being assembled for use, characterised in that a portion of each of the two side outer walls is hinged at one end to a respective end of one of the front or rear outer walls.

Front, rear and side walls are referred to throughout the specification. However unless otherwise stated, these terms have been used merely to assist in the reading of the specification. Such terms should not be construed in any way to be limiting. For example, unless otherwise stated, front and rear walls need not be longer than side walls and vice versa. Indeed what is termed a "rear wall" of the inner structure need not necessarily lie adjacent to what is termed the rear wall of the outer structure.

The term "flat pack", as used in the context of the specification, does not require that every component of the container be flat but merely that the components of the containers are such that they may be arranged so as to provide a generally flat pack, enabling two or more disassembled containers to be stacked one upon the other.

A shipper container in accordance with embodiments of the present disclosure, wherein a portion of each of the side outer walls is hinged at one end to a respective end of one of the front or rear outer walls, reduces the number of components to be unpacked, to be arranged for reassembly and subsequently to be reassembled, thus increasing the speed of pack out process and reducing the possibility of errors. The hinging of portions of the side outer walls to either the front or rear outer walls also means that when they are to be assembled on the base the walls can be positioned in place in an L-shaped or U-shaped configuration and will thus be free standing, avoiding the requirement to support one wall in an upright position until an adjacent wall is mounted to it in order that they may be self-supporting, which may have previously been the case. Additionally, the hinging of the corners may increase the robustness of the container making the container more resistant to distortion if it receives inappropriate handling, which distortion may disrupt the thermal barrier, which may result in failure of the container.

Advantageously, each side portion of said outer wall is hinged to a respective end of the front outer wall and can be folded flat against the front outer wall. In this manner, the front outer wall with the two portions of the side outer walls can be folded flat making it easy to handle while ensuring the three components are correctly arranged on assembly with only minimal effort.

Advantageously, the side outer wall portions are first portions of respective side outer walls and the side outer walls each comprise a respective second portion arranged to abut against the respective first portion, the second portions being joined substantially at right angles to respective ends of the rear outer wall to form a U-shaped outer wall component.

In this manner, the complete outer wall can be correctly assembled by merely placing the two subassemblies together. Where the outer and inner structures of the container are of a different colour, or a different type of material, such that they can easily be identified, and the top and bottom edges of the outer walls are the same, so it does not matter which way up they are mounted, then even the most inexperienced assembler should be able to correctly assemble the outer structure.

Advantageously, the inner lid, front inner wall, rear inner wall and side inner walls are arranged so that they can be stacked flat upon the inner base, wherein the length of the second portions of the outer side walls is sufficient that when the inner base is on the outer base and the remaining components of the inner structure are stacked flat upon the inner base, the U-shaped outer wall component may be placed inverted on the outer base such that it bridges over the components of the inner structure, whereby the front outer wall with the first portions of the side outer wall folded flat against it, may be placed on and supported by the U-shaped outer wall component.

The disclosure in accordance with the above embodiment enables several components to be preassembled whilst at the same time ensuring that the container can still be flat packed. Another advantage is that when the flat packed container is unpacked prior to assembly, the first two components to be removed are the outer walls and therefore will not be required until the product has been packed within the inner structure and the cool packs provided around the inner structure, thus these first two components to be unpacked may be placed towards the back of the working area while the components of the inner structure, which will be required first can be placed conveniently for reassembly.

Advantageously, the materials and dimensions of the container are selected such that in a flat packed state the U-shaped outer wall component is designed to be of sufficient strength to permit at least two identical flat packed containers to be supported by it when it is inverted on the outer base. This permits a stack of flat pack containers to be moved as an item, normally by means of a forklift lifting the pallet of the lowermost container in the stack.

Advantageously, of the components of the container are attached and arranged such that the container may be transported in a flat packed state without the need to package the container in a sleeve. In this manner, a flat packed container may be distributed without the need for any other packaging materials, which may be advantageous to a customer for the containers and which reduces the cost of the shipper to the customer.

Embodiments have been described above as comprising an inner base and an outer base. These may be separate components with, for example, a layer of cool packs placed between them. Alternatively they may be a single component, possibly with a number of apertures therein for receiving cool packs, provided that in the case of common component this is arranged such as to engage both with the inner walls and outer walls, in an appropriate manner.

Whether the base is a common component or two separate components, it may be preferable that the outer base is mounted on a pallet to assist with handling of the container.

Advantageously, the inner structure is arranged such that the inner walls may be positioned around the edge of the inner base and the inner lid placed on top of the inner walls to define a payload space within the inner structure, the components of the inner structure being arranged to engage with each other such that the inner structure is self-supporting.

It may also be advantageous if at least two, and preferably three, of the front inner wall, rear inner wall and two side inner walls are hinged to the inner base so that they may be folded from a flat state, where they lie substantially flat over the inner base, to a vertical position. In the case where three walls are hinged to the inner base, this permits the three inner walls to simply be unfolded to correctly position them to define a payload space that may then be filled with a product, prior to the final inner wall being placed in position and the inner lid being placed on the container.

Advantageously, a plurality of retainers are secured on the outer surface of the inner walls, which retainers are arranged to retain a plurality of cool packs in place prior to and after the outer wall has been positioned in place. In this manner, retainers for maintaining cool packs in place are already secured to the outer surfaces of the inner walls, again reducing the number of components that have to be assembled and also ensuring that the components are correctly assembled.

Preferably, the inner structure and outer structure are made of rigid thermal insulating materials such as expanded polystyrene, with the material of the inner structure having a greater density than the material of the outer structure. This is desirable because this will give the inner structure greater strength and it is this structure which will support and retain a product in place during shipment.

Preferably, the retainers are in the form of extruded channels and are formed from two co-extruded materials, with the edges of the retainers formed of a softer material than central regions of the retainers. In this way, the central regions of the retainers, those parts which are to engage with the side walls and support the cool packs, may be of a relatively hard material with the edges relatively soft to reduce the risk of injury to an assembler. The softer edges may also provide resilience to assist in securing the cool packs in place.

Advantageously, the container is capable of being assembled and taken apart and put back into flat pack state ready to be reused without the need to replace any components of the container and such a container would be expected to have at least three life cycles. In this regard, it is advantageous if the container is free of wood based products, for wood based products may tend to deteriorate due to condensation forming on the cool packs.

According to a second aspect of the present disclosure there is provided a thermally insulated shipping container comprising: an inner structure including an inner base, a front inner wall, a rear inner wall opposed to the front inner wall, a pair of opposed side inner walls each extending between the front and rear inner walls and an inner lid; an outer structure including an outer base, a front outer wall, a rear outer wall opposed to the front inner wall, two side outer walls each extending between the front and rear outer walls and an outer lid; and a cavity between the inner and outer structure arranged to receive a plurality of cool packs; wherein the container, when empty, is arranged to be transported disassembled in a flat packed state prior to being assembled for use, with two portions of the side outer walls joined substantially at right angles to respective ends of the outer wall to form a U-shaped outer wall component.

The above aspect of the present disclosure provides the advantages previously described of having a container with a U-shaped outer wall component.

Again, it is advantageous if the inner lid, rear inner wall, front inner wall and side inner walls are arranged so that they can be stacked flat upon the inner base, wherein the lengths of the two portions of the outer side walls are sufficient that when the inner base is on the outer base and the remaining components of the inner structure are stacked flat upon the inner base, the U-shaped outer wall component may be placed inverted on the outer base such that it bridges over the components of the inner structure, whereby the front outer wall with the first portions of the side outer wall folded flat against it, may be placed on and supported by the U-shaped outer wall component.

A container in accordance with the present disclosure may be particularly advantageously employed as an LD7 pallet or a unit load device as defined by the International Air Transport Association.

It is advantageous that the length of two opposed side wall portions each have a length less than or equal to one half of the length of one side of the container. If the side wall portions are hinged to either the front or rear outer wall this permits the thickness of the component comprising the front or rear outer wall and two side wall portions to be the same as the front or rear outer wall and one outer wall portion. Alternatively, when the side wall portions form part of the U-shaped outer wall component, they permit the U-shaped outer wall component, when inverted to be substantially stable and support one or more similar flat pack containers thereupon, permitting several containers to be stacked together when in their flat packed state.

Preferably, the height of the outer walls is between 80 to 100 percent of the length of one side of the container. Thus, when the container has a U-shaped outer wall section, when this is positioned inverted over the outer base it will cover 80 to 100 percent of the outer base. This may enable it to protect other components, such as components of the inner structure when in a flat packed state on the base.

BRIEF DESCRIPTION OF THE FIGURES

One embodiment of the present disclosure will now be described, by way of example only, with reference to the accompanying drawings, of which:

FIG. 1 is a perspective view of a flat packed pallet shipper in accordance with the present disclosure;

FIG. 2 illustrates the shipper of FIG. 1 partly unpacked;

FIG. 3 illustrates a shipper of FIGS. 1 and 2 after further unpacking;

FIG. 4 illustrates a shipper of FIG. 1 with an inner wall partly constructed;

FIG. 5 shows the shipper of FIG. 4 once the inner wall has been completed and the inner lid has been placed upon the shipper;

FIG. 6 illustrates the shipper of FIG. 5 once some of the cool packs have been placed around the inner wall;

FIG. 7 illustrates the outer wall being assembled on the shipper;

FIG. 8 illustrates the shipper with the outer lid in position and the shipper ready for shipment;

FIG. 9 is a cross-section through an edge protector used on the shipper of FIGS. 1 to 8;

FIG. 10 is a cross-section through a cool pack retainer of the container of FIGS. 1 to 8;

FIG. 11 is a cross-section through a corner post and hinge of the containers of FIGS. 1 to 8;

FIGS. 12 and 13 illustrate an alternative configuration of inner structure for the container; and FIG. 14 is cross section through an inner hinge assembly seen in embodiment of FIGS. 12 and 13.

DETAILED DESCRIPTION

Referring to FIG. 1 there is illustrated a thermal insulated pallet shipping container "shipper" 1. The shipper 1 comprises a pallet 2 on which is mounted a base 3. Loosely positioned on the base 3 are inner wall sections 4 and 5 and an inner lid 6, 7. Positioned over these in a bridge-like manner is a U-shaped outer wall section 8, which turn supports a further folded outer wall section 9 and an outer lid 10. The outer wall section 8 is strong enough to permit at least another 2 flat pack shippers to be stacked on the shipper 1.

FIGS. 2 to 8 illustrate how the flat pack shipper 1 is first unpacked and then assembled ready for shipment. With reference to FIG. 2, the outer lid 10 and outer wall section 9 are first removed and placed to one side. Then, as shown in FIG. 3, the U-shaped outer wall section 8 and inner lid 6, 7 can be removed, together with first folded inner wall section 4, leaving the second folded inner wall section 5 on the base 3.

With reference to FIG. 4, the second inner wall section 5 is shown with inner side wall portions 11 and 12 unfolded relative to inner rear wall portion 13. These inner side wall portions 11 and 12 are held in place by hinges 14 and 15, only one of which is seen in FIG. 4. (Alternatively the inner wall section 5 could be made from a laminate foam board with the board being scored through from one side through one layer of laminate only, to form an in-built hinge). Regardless of the hinge construction, the inner wall section 4 of FIG. 3 can then be erected in a similar manner and positioned so that it abuts inner wall section 5, as shown in FIG. 5, with the bottom edges of the inner wall sections 4 and 5 sitting in channel 16, seen in FIG. 4, of base 3. The container may be filled with a product (not shown) to be shipped when in the state illustrated in FIG. 4, especially if the product is itself on a pallet. The inner lid, comprising two sections 6 and 7 is then put in place as shown in FIG. 5, completing the inner structure of the shipper 1. Preassembled on the inner wall sections 4 and 5 are a plurality of cool pack retainers 17. As shown with reference to FIG. 6, these receive cool packs 18 in a predetermined order. The cool packs may be either frozen, indicated by a "−" sign, or chilled, as indicated by a "+" sign. Once an appropriate number of cool packs 18 have been inserted in the retainers 17 and placed in recesses 19 in inner lid 6 and 7, the outer wall section 9 is infolded in the same manner as the previously described inner wall sections 4, 5 and the outer wall sections 8 and 9 are abutted together, as shown in FIG. 7, prior to outer lid 10 being mounted on the top edge of the outer walls sections 8 and 9 to complete the shipper. The outer lid 10 and base 3 have a number of small PVC extrusions 20 that sit in the top surface of the outer lid and the bottom surface of the base to provide strapping points to secure the system and to prevent any damage to the outer lid or base.

Although it is not immediately apparent from the figures, the base and lid have the same outer edge stepped profile. Likewise the top and bottom edges of the outer wall sections 8 and 9 also have the same stepped profile, thus avoiding the requirement for the outer wall sections 8 or 9 to have up and down orientation. Similarly, the top edges of the inner wall sections 4 and 5 and bottom edges of the inner wall sections 4 and 5 may have the same profile with a groove similar to the groove 16 in the base 3 provided on the under surface of inner lid 6, 7. In this manner the inner wall sections 4 and 5 may be arranged to have no up or down orientation, thus assisting pack out.

Referring to FIGS. 9 to 11 there is shown in cross-section the profile of the extruded components used in the container 1 of FIGS. 1 to 8. FIG. 9 shows the cross section of the strapping point extrusions 20 and it can be seen that this has two barb-like sections 21 and 22 for engaging in the material of the outer lid 10 or base 3, which may typically be a low density expanded polystyrene.

Referring to FIG. 10 there is shown the cross-section of a cool pack retainer 17. Again this has barb-like members 23 and 24 by which the retainer 17 engages with inner wall sections 4 and 5 of the shipper 1, which sections may again be made of expanded polystyrene but with a higher density than the polystyrene used in the outer wall sections 8 and 9, to give the inner wall sections 4 and 5 of the shipper 1 greater strength. (As an alternative to the barb-like members 23 and 24, the cool pack retainers could be assembled by being secured with the inner wall sections 4 and 5 for example, by being screwed from behind). The cool packs sit in channels 25 and 26 and are retained in place by the retainer 17 formed of PVC. The retainer 17 is co-extruded and the end sections 27 are formed of a softer compound to avoid the possibility of injury when loading the cool packs.

Referring to FIG. 11, there is shown the cross-section of one of the corner hinges 14. This is extruded from PVC and hinge member 28 permits the first section 29 to pivot relative to the second section 30. An extension 31 to the first section 29 engages with recess 32 in the second section 30 to lock wall sections mounted in the hinge 14 so that the wall sections extend perpendicularly away from each other.

Referring now to FIG. 12, there is shown an alternative arrangement which may be used for the inner structure of the shipper of FIGS. 1 to 8. Here three sections 33, 34, 35 are shown hinged by hinges 36 to a base 37 and these may simply be raised to define a payload space into which a product can be loaded prior to the final section 38 being dropped into a channel 39 and an inner lid 40, with a similar channel being placed on the inner walls to complete the inner section of the shipper 1. The hinges 36 are shown in cross-section in FIG. 14. These are again formed from extruded PVC and are hinged by hinge member 42, the extruded hinge having a locking mechanism 43 identical to that described with reference to FIG. 11.

It will be appreciated that the present disclosure has been described by way of example only and that many alternative configurations and arrangements will be apparent to the person skilled in the art, which alternations and configurations may fall within the scope of the appended claims.

The invention claimed is:

1. A thermally insulated shipping container comprising:

an inner structure including an inner base, a front inner wall, a rear inner wall opposed to the front inner wall, a pair of opposed side inner walls each extending between the front inner wall and the rear inner wall and an inner lid;

an outer structure including an outer base, a front outer wall, a rear outer wall opposed to the front outer wall, two side outer walls each extending between the front outer wall and the rear outer wall and an outer lid; and a cavity between the inner structure and the outer structure arranged to receive a plurality of cool packs;

wherein the container, when empty, is arranged to be transported disassembled in a flat packed state prior to being assembled for use, wherein respective first portions of both of the two side outer walls are joined substantially at right angles to respective ends of the front outer wall or the rear outer wall to form a U-shaped outer wall component, and wherein the inner lid, the rear inner wall, the front inner wall and the side inner walls are arranged so that they are configured to be stacked flat upon the inner base, wherein the lengths of the two first portions of the side outer walls are sufficient that when the inner base is on the outer base and remaining components of the inner structure are stacked flat upon the inner base, the U-shaped outer wall component is configured to be placed inverted on the outer base such that it forms a bridge over the components of the inner structure.

2. The container of claim 1, wherein the remaining front outer wall or rear outer wall with respective second portions of the side outer wall folded flat against it, is configured to be placed on and supported by the U-shaped outer wall component.

3. The container of claim 1, wherein materials and dimensions of the container are selected such that in a flat packed state the U-shaped outer wall component is designed to be of sufficient strength to permit at least two identical flat packed containers to be supported by it when it is inverted on the outer base.

4. The container of claim 2, wherein the components of the container are attached and arranged such that the container is configured to be transported in a flat packed state without the need to package the container in a sleeve.

5. The container of claim 1, wherein a height of the outer walls is between 80 to 100 percent of a length of one side of the container, such that the U-shaped outer wall section is configured to be positioned over 80 to 100 percent of the outer base.

6. The container of claim 1, wherein the inner base and the outer base are formed from a common component.

7. The container of claim 1, wherein the outer base is mounted on a pallet.

8. The container of claim 1, wherein the inner structure is arranged such that the inner walls are configured to be positioned around an edge of the inner base and the inner lid placed on top of the inner walls to define a payload space within the inner structure, the components of the inner structure being arranged to engage with each other such that the inner structure is self-supporting.

9. The container of claim 8, wherein at least two of the front inner wall, the rear inner wall and the two inner side walls are hinged to the inner base so that they are configured to be folded from a flat state, where they lie substantially flat over the inner base to a vertical position.

10. The container of claim 9, wherein at least three of the front inner wall, the rear inner wall and the two inner side walls are hinged to the inner base so that they are configured to be folded from a flat state where they lie substantially flat over the inner base to a vertical position.

11. The container of claim 1, wherein a portion of each of the two side inner walls is hinged at one end to a respective end of the front inner wall or the rear inner wall.

12. The container of claim 1, wherein a plurality of retainers are secured to the outer surfaces of the inner walls, wherein the retainers are arranged to retain a plurality of cool packs in place prior to and after the outer walls are positioned in place.

13. The container of claim 12, wherein the plurality of retainers are extruded channels.

14. The container of claim 12, wherein the plurality of retainers are formed from two co-extruded materials, with edges of the plurality of retainers formed of a softer material than central regions of the plurality of retainers.

15. The container of claim 1, wherein the inner structure and the outer structure are made of rigid thermally insulating materials and material of the inner structure has a greater density than material of the outer structure.

16. The container of claim 1, wherein the container is configured to be assembled and taken apart and put back into a flat pack state ready to be reused without a requirement to replace any components of the container.

17. The container of claim 1, wherein the respective first portions of the side outer walls are fixed substantially at right angles to respective ends of the front outer wall or the rear outer wall.

18. The container of claim 17, wherein each of the side outer walls further comprise a respective second portion arranged to abut against the respective first portion, the second portions being hinged to respective ends of the remaining front outer wall or rear outer wall.

19. The container of claim 1, wherein the respective first portions of the side outer walls are hinged to respective ends of the front outer wall or the rear outer wall.

20. The container of claim 19, wherein each of the side outer walls further comprise a respective second portion arranged to abut against the respective first portion, the second portions being fixed substantially at right angles to respective ends of the remaining front outer wall or rear outer wall.

* * * * *